US012691492B2

(12) United States Patent
Uchizono et al.

(10) Patent No.: US 12,691,492 B2
(45) Date of Patent: Jul. 28, 2026

(54) THIXOTROPICALLY MOLDED PRODUCT, THIXOTROPIC MOLDING MATERIAL, AND METHOD OF PRODUCING THIXOTROPIC MOLDING MATERIAL

(71) Applicant: SEIKO EPSON CORPORATION, Tokyo (JP)

(72) Inventors: Shunsuke Uchizono, Shiojiri (JP); Yasutoshi Hideshima, Matsumoto (JP); Setsuya Iwashita, Nirasaki (JP); Fumiya Maeda, Matsumoto (JP); Koichi Ozaki, Okayama (JP); Tadao Fukuta, Kurashiki (JP)

(73) Assignee: SEIKO EPSON CORPORATION (JP)

( * ) Notice: Subject to any disclaimer, the term of this patent is extended or adjusted under 35 U.S.C. 154(b) by 411 days.

(21) Appl. No.: 18/397,832

(22) Filed: Dec. 27, 2023

(65) Prior Publication Data

US 2024/0216988 A1 Jul. 4, 2024

(30) Foreign Application Priority Data

Dec. 28, 2022 (JP) ..... 2022-211892

(51) Int. Cl.

| | |
|---|---|
| ***B32B 9/00*** | (2006.01) |
| ***B22D 21/00*** | (2006.01) |
| ***C22C 1/10*** | (2023.01) |
| *C22C 23/02* | (2006.01) |

(52) U.S. Cl.
CPC ..... *B22D 21/007* (2013.01); *C22C 1/1068* (2013.01); *C22C 23/02* (2013.01)

(58) Field of Classification Search
CPC ..... B22D 21/007; C22C 1/1068
USPC ..... 428/408
See application file for complete search history.

(56) References Cited

U.S. PATENT DOCUMENTS

| | | | | |
|---|---|---|---|---|
| 5,672,433 | A * | 9/1997 | Cook | H10W 40/257 428/614 |
| 2007/0104606 | A1 | 5/2007 | Moll et al. | |
| 2011/0256419 | A1 | 10/2011 | Iwayama et al. | |
| 2017/0268088 | A1* | 9/2017 | Sherman | C22F 1/06 |
| 2022/0314315 | A1 | 10/2022 | Uchizono et al. | |

FOREIGN PATENT DOCUMENTS

| | | | |
|---|---|---|---|
| CN | 110125404 B | * | 11/2021 |
| JP | 2007-510545 A | | 4/2007 |
| JP | 2010-090436 A | | 4/2010 |
| JP | 2022-154214 A | | 10/2022 |

* cited by examiner

*Primary Examiner* — Daniel H Miller
(74) *Attorney, Agent, or Firm* — Harness, Dickey & Pierce, P.L.C.

(57) ABSTRACT

A thixotropically molded product includes: a matrix portion containing Mg as a main component; a first particle portion dispersed in the matrix portion and containing SiC as a main component; a second particle portion dispersed in the matrix portion and containing $Mg_2Si$ as a main component; and a third particle portion dispersed in the matrix portion and containing MgO as a main component. An area fraction of the first particle portion in a cross section is 0.68 or more and 19.6% or less.

7 Claims, 3 Drawing Sheets

THIXOTROPICALLY MOLDED PRODUCT, THIXOTROPIC MOLDING MATERIAL, AND METHOD OF PRODUCING THIXOTROPIC MOLDING MATERIAL

The present application is based on, and claims priority from JP Application Serial Number 2022-211892, filed Dec. 28, 2022, the disclosure of which is hereby incorporated by reference herein in its entirety.

BACKGROUND

1. Technical Field

The present disclosure relates to a thixotropically molded product, a thixotropic molding material, and a method of producing a thixotropic molding material.

2. Related Art

Magnesium has properties of a low specific gravity and good electromagnetic wave shielding properties, good vibration damping capability, good machinability, and good biosafety. Based on such a background, magnesium alloy components are beginning to be used in products such as automobile components, aircraft components, mobile phones, and notebook computers.

A thixotropic molding method is known as a method of producing components made of magnesium. The thixotropic molding method is a molding method in which a molding material is heated in a cylinder to bring the material into a solid-liquid coexistence state in which a liquid phase and a solid phase coexist, then thixotropy is developed by rotation of a screw, and the obtained semi-solidified product is injected into a mold. According to such a thixotropic molding method, since fluidity of the semi-solidified product is enhanced by heating and shearing, a thin component or a component having a complicated shape can be formed as compared with a die casting method.

For example, JP-T-2007-510545 discloses a method of producing a metal-based composite material in which at least 2 vol % of an $Mg_2Si$ phase is incorporated into a metal base material containing magnesium or a magnesium alloy by a method in which granules of magnesium or a magnesium alloy and granules of silicon or a silicon alloy are introduced to a thixotropic molding step and solidified under shearing. Accordingly, the $Mg_2Si$ phase is a reinforcing material, and high-temperature characteristics of the metal base material can be improved.

In the method described in JP-T-2007-510545, when the metal-based composite material is produced, the granules of magnesium or the like and the granules of silicon or the like are directly used in the thixotropic molding step. In the thixotropic molding step, the granules are mixed by applying a shearing force to the granules by a screw in a heated cylinder. However, mixing using the screw alone does not allow the granules to be mixed uniformly due to separation caused by a difference in specific gravity of the granules and an insufficient mixing time. In this case, segregation or aggregation of silicon or the silicon alloy is likely to occur in the mixture. Such segregation or aggregation causes a problem that mechanical strength or rigidity cannot be sufficiently enhanced.

SUMMARY

A thixotropically molded product according to an application example of the present disclosure includes: a matrix portion containing Mg as a main component; a first particle portion dispersed in the matrix portion and containing SiC as a main component; a second particle portion dispersed in the matrix portion and containing $Mg_2Si$ as a main component; and a third particle portion dispersed in the matrix portion and containing MgO as a main component. An area fraction of the first particle portion in a cross section is 0.6% or more and 19.6% or less.

A thixotropic molding material according to an application example of the present disclosure includes: a metal body containing Mg as a main component; silicon carbide particles adhering to a surface of the metal body and containing SiC as a main component; and interposed particles interposed between the metal body and the silicon carbide particles and made of an inorganic material. A ratio of the silicon carbide particles to a total of the metal body and the silicon carbide particles is 1.0 mass % or more and 30.0 mass % or less.

A method of producing a thixotropic molding material according to an application example of the present disclosure includes: a preparation step of preparing a mixture containing a metal body containing Mg as a main component, silicon carbide particles containing sic as a main component, interposed particles made of an inorganic material, and a dispersion medium; a stirring step of stirring the mixture; and a drying step of adhering the silicon carbide particles to a surface of the metal body via the interposed particles by removing at least a part of the dispersion medium from the stirred mixture. In the mixture, a ratio of the silicon carbide particles to a total of the metal body and the silicon carbide particles is 1.0 mass % or more and 30.0 mass % or less.

DESCRIPTION OF EMBODIMENTS

Hereinafter, a thixotropically molded product, a thixotropic molding material, and a method of producing a thixotropic molding material according to the present disclosure will be described in detail based on embodiments shown in the accompanying drawings.

1. Thixotropic Molding Method

First, an example of a thixotropic molding method of producing a thixotropically molded product will be described.

The thixotropic molding method is a molding method in which a pellet-shaped or chip-shaped raw material is heated in a cylinder to bring the material into a solid-liquid coexistence state in which a liquid phase and a solid phase coexist, then thixotropy is developed by rotation of a screw, and the obtained semi-solidified product is injected into a mold. According to such a thixotropic molding method, since fluidity of the semi-solidified product is enhanced by heating and shearing, a thin component or a component having a complicated shape can be formed as compared with, for example, a die casting method.

Figure 1:
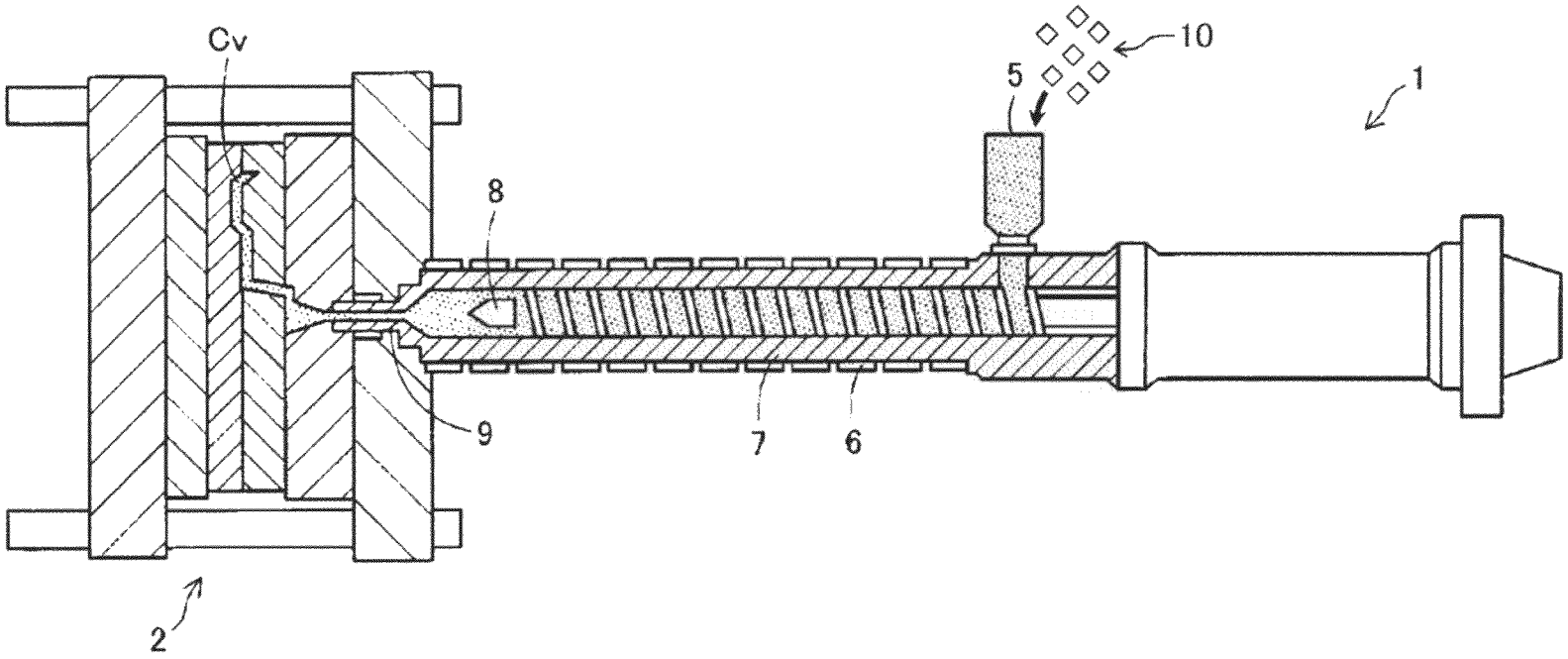
FIG. 1 is a cross-sectional view showing an example of an injection molding machine used in a thixotropic molding method.

FIG. 1 is a cross-sectional view showing an example of an injection molding machine 1 used for the thixotropic molding method.

As shown in FIG. 1, the injection molding machine 1 includes a mold 2, a hopper 5, a heating cylinder 7, a screw 8, and a nozzle 9. A cavity Cv is formed in the mold 2. When a thixotropic molding material 10 is charged into the hopper 5, the thixotropic molding material 10 is supplied to the heating cylinder 7. The thixotropic molding material 10 supplied to the heating cylinder 7 is heated by a heater 6 and conveyed while being sheared by the screw 8. Accordingly, the thixotropic molding material 10 is semi-melted and slurried. The obtained slurry is injected into the cavity Cv in the mold 2 through the nozzle 9 without being exposed to the atmosphere. Then, the slurry injected into the cavity Cv is cooled to obtain a thixotropically molded product.

A material containing magnesium as a main component is used as the thixotropic molding material 10. The hopper 5 may be charged with other materials together with the thixotropic molding material 10.

2. First Embodiment

Next, a thixotropic molding material according to a first embodiment will be described.

Figure 2:
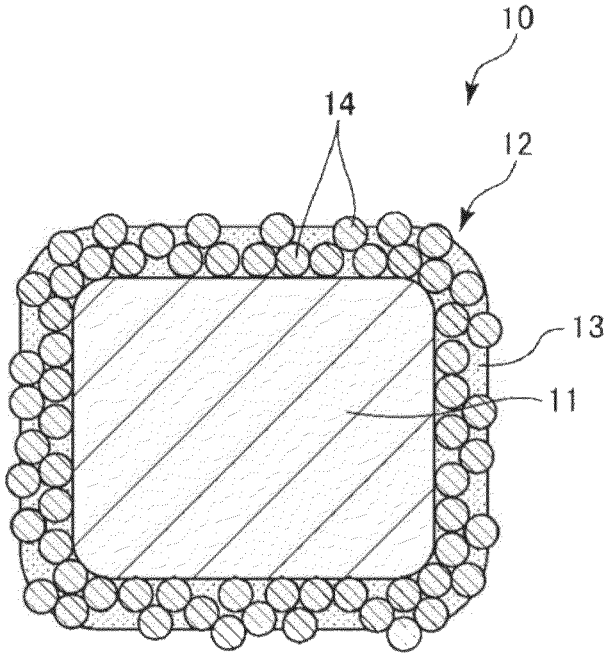
FIG. 2 is a cross-sectional view schematically showing a thixotropic molding material according to a first embodiment.
Figure 3:
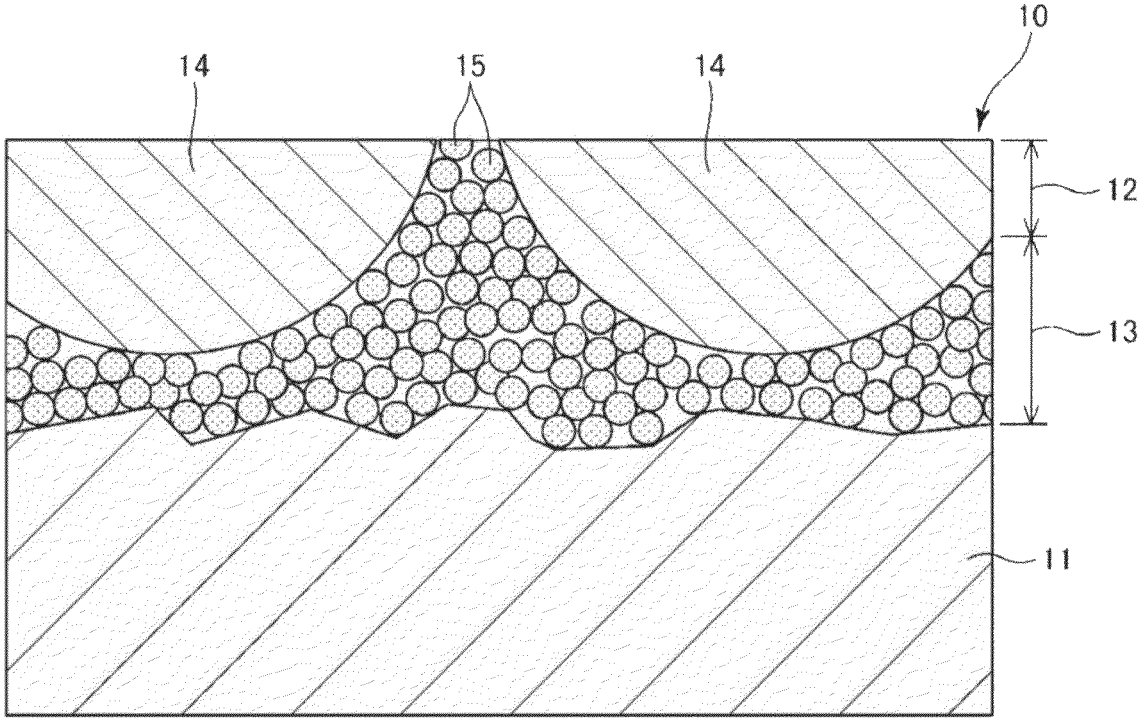
FIG. 3 is a partially enlarged view of FIG. 2.

FIG. 2 is a cross-sectional view schematically showing the thixotropic molding material 10 according to the first embodiment. FIG. 3 is a partially enlarged view of FIG. 2.

The thixotropic molding material 10 shown in FIG. 2 includes a chip-shaped metal body 11, a coating portion 12 provided on a surface of the metal body 11, and a bonding portion 13 interposed between the metal body 11 and the coating portion 12.

The metal body 11 contains Mg as a main component. As shown in FIG. 2, the coating portion 12 includes a plurality of silicon carbide particles 14. The silicon carbide particles 14 are provided on the surface of the metal body 11. The silicon carbide particles 14 contain SiC (silicon carbide) as a main component.

The bonding portion 13 penetrates between the metal body 11 and the silicon carbide particles 14 and between the silicon carbide particles 14 to bond them. As shown in FIG. 3, the bonding portion 13 includes a plurality of interposed particles 15.

By performing thixotropic molding using the thixotropic molding material 10 having the bonding portion 13, the silicon carbide particles 14 are prevented from falling off. Therefore, a semi-molten material of the metal body 11 and the silicon carbide particles 14 are likely to be uniformly mixed in the heating cylinder 7. Accordingly, the silicon carbide particles 14 are uniformly dispersed in the semi-molten material. As a result, a thixotropically molded product in which SiC is uniformly distributed in a matrix portion generated from the metal body 11 can be produced.

The silicon carbide particles 14 have high yield strength and elastic modulus derived from SiC. Therefore, in the thixotropically molded product in which the silicon carbide particles 14 are distributed, high specific strength and specific rigidity derived from Mg can be further enhanced. Since the silicon carbide particles 14 are uniformly dispersed, it is possible to inhibit enlargement of Mg crystals precipitated in a process of solidification during the thixotropic molding. Accordingly, refinement of the Mg crystals can be achieved, and a movement of dislocation can be prevented. As a result, specific strength and specific rigidity of the obtained thixotropically molded product can be further enhanced.

The interposed particles 15 act to enhance wettability between the silicon carbide particles 14 and the semi-molten material of the metal body 11 during the thixotropic molding. Accordingly, in the produced thixotropically molded product, affinity and adhesion between a site derived from the silicon carbide particles 14 and a site derived from the metal body 11 can be enhanced. As a result, it is possible to produce a thixotropically molded product which is denser and has enhanced mechanical strength.

2.1. Metal Body

The metal body 11 is, for example, a section obtained by machining or cutting an Mg-based alloy cast with a mold or the like. A method of producing the metal body 11 is not limited thereto.

A material containing Mg as a main component is used as a constituent material of the metal body 11. Containing Mg as a main component refers to that, when elemental analysis is performed on the metal body 11, a content of Mg is the highest in terms of atomic ratio. For the elemental analysis, for example, a qualitative and quantitative analysis based on an energy dispersive X-ray spectroscopy (EDX) is used. The content of Mg in the metal body 11 may be higher than that of other elements, and is preferably more than 50 atomic %, more preferably 70 atomic % or more, and still more preferably 80 atomic % or more.

The metal body 11 may contain various additive components other than Mg. Examples of the additive components include lithium, beryllium, calcium, aluminum, silicon, manganese, iron, nickel, copper, zinc, strontium, yttrium, zirconium, silver, tin, gold, and rare earth elements, and one or a mixture of two or more of these components is used. Examples of the rare earth elements include cerium.

In particular, the additive component preferably contains at least one of aluminum and zinc, and more preferably contains both aluminum and zinc. Accordingly, a melting point of the thixotropic molding material 10 decreases, and fluidity of the semi-solidified product during the thixotropic molding is improved. As a result, moldability during the thixotropic molding is enhanced, and thus dimensional accuracy of the produced thixotropically molded product can be enhanced.

A content of aluminum in the metal body 11 is, for example, preferably 5.0 mass % or more and 13.0 mass % or less, and more preferably 7.0 mass % or more and 11.0 mass % or less. A content of zinc in the metal body 11 is, for example, preferably 0.3 mass % or more and 3.0 mass % or less, and more preferably 0.5 mass % or more and 2.0 mass % or less.

In addition to aluminum and zinc, the additive component preferably contains at least one selected from the group consisting of silicon, manganese, yttrium, strontium, and rare earth elements. Accordingly, mechanical properties, corrosion resistance, wear resistance, and thermal conductivity of the thixotropically molded product can be enhanced.

A composition of the metal body 11 may be a composition of a magnesium alloy defined in various standards. Examples of such a magnesium alloy include AZ91A, AZ91B, AZ91D, AM60A, AM60B, AS41A, AZ31, AZ31B, AZ61A, AZ63A, AZ80A, AZ91C, AZ91E, AZ92A, AM100A, ZK51A, ZK60A, ZK61A, EZ33A, QE22A, ZE41A, MIA, WE54A, and WE43B of the American Society for Testing and Materials (ASTM) standard. Among these, AZ91A, AZ91B, or AZ91D are preferably used. These magnesium alloys are useful because of well-balanced moldability, mechanical properties, and the like, and are excellent in corrosion resistance.

The additive component may be present in a form of a simple substance, an alloy, an oxide, an intermetallic compound, and the like in the metal body 11. The additive component may be segregated or uniformly dispersed in a crystal grain boundary of a metal structure such as Mg or an Mg alloy in the metal body 11.

An average particle diameter of the metal body 11 is not particularly limited, and is preferably 0.5 mm or more, and more preferably 1.5 mm or more and 10.0 mm or less. By setting the average particle diameter within the above range, generation of bridges and the like in the heating cylinder 7 of the injection molding machine 1 can be prevented.

The average particle diameter of the metal body 11 is an average value of diameters of circles having an area same as a projected area of the metal body 11. The average value is calculated based on 100 or more randomly selected metal bodies 11.

An average aspect ratio of the metal body 11 is preferably 5.0 or less, and more preferably 4.0 or less. In the metal body 11 having such an average aspect ratio, a filling property in the heating cylinder 7 is enhanced and temperature uniformity during heating is improved. As a result, a thixotropically molded product having high mechanical properties and high dimensional accuracy can be obtained.

The average aspect ratio of the metal body 11 is an average value of aspect ratios calculated from major axis/minor axis in a projection image of the metal body 11. The average value is calculated based on 100 or more randomly selected metal bodies 11. The major axis is a maximum length that can be taken in the projection image, and the minor axis is a maximum length in a direction orthogonal to the major axis.

The metal body 11 may be subjected to any surface treatment as necessary. Examples of the surface treatment include a plasma treatment, a corona treatment, an ozone treatment, an ultraviolet irradiation treatment, and a roughening treatment.

2.2. Coating Portion

The coating portion 12 includes the plurality of silicon carbide particles 14. In the embodiment, as shown in FIG. 2, the plurality of silicon carbide particles 14 are distributed to cover the surface of the metal body 11, thereby forming the coating portion 12. The coating portion 12 preferably covers the entire surface of the metal body 11, or may cover only a part of the surface.

The silicon carbide particles 14 are dispersed in the semi-molten material when subjected to the thixotropic molding. The silicon carbide particles 14 are less likely to vaporize during the thixotropic molding, and can be prevented from causing molding defects.

The silicon carbide particles 14 contain SiC as a main component. SiC may be amorphous SiC or crystalline SiC. Containing the SiC as a main component refers to that, when the elemental analysis is performed on the silicon carbide particles 14, a content of one of Si and C is the highest and a content of the other is the second highest in terms of atomic ratio. For the elemental analysis, for example, a qualitative and quantitative analysis based on an energy dispersive X-ray spectroscopy (EDX) is used. A total content of Si and C in the silicon carbide particles 14 may be higher than that of other elements, and is preferably more than 50 atomic %, and more preferably 60 atomic or more.

An average particle diameter of the silicon carbide particles 14 is preferably 0.3 μm or more and 20 μm or less, more preferably 1 μm or more and 15 μm or less, and still more preferably 2 μm or more and 10 μm or less. By setting the average particle diameter of the silicon carbide particles 14 within the above range, when the silicon carbide particles 14 adhere to the surface of the metal body 11 and is subjected to the thixotropic molding, the silicon carbide particles 14 can be uniformly distributed, and the silicon carbide particles 14 are less likely to fall off from the surface of the metal body 11. As a result, a thixotropically molded product in which sites derived from the silicon carbide particles 14 are satisfactorily dispersed can be produced.

When the average particle diameter of the silicon carbide particles 14 is less than the above lower limit value, the particle diameter of the silicon carbide particles 14 is too small, and thus the silicon carbide particles 14 may be less likely to function as a reinforcing material that enhances mechanical properties of the thixotropically molded product. On the other hand, when the average particle diameter of the silicon carbide particles 14 is more than the above upper limit value, the silicon carbide particles 14 may be likely to fall off from the surface of the metal body 11. In addition, the silicon carbide particles 14 are likely to become a starting point of breakage, and the mechanical strength of the thixotropically molded product may decrease.

The average particle diameter of the silicon carbide particles 14 is a value obtained by measuring the particle diameters of the silicon carbide particles 14 from an observation image of the silicon carbide particles 14 magnified and observed with a microscope and averaging 100 or more pieces of measurement data. As the microscope, for example, a scanning electron microscope or an optical microscope is used. The particle diameters of the silicon carbide particles 14 are intermediate values between a length of the major axis and a length of the minor axis in the observation image of the silicon carbide particles 14.

A ratio of the silicon carbide particles 14 to a total of the metal body 11 and the silicon carbide particles 14 is 1.0 mass % or more and 30.0 mass % or less. By setting the ratio of the silicon carbide particles 14 within the above range, the silicon carbide particles 14 are less likely to fall off from the metal body 11. In addition, a ratio of the site derived from the metal body 11 to the site derived from the silicon carbide particles 14 can be optimized in the produced thixotropically molded product. Accordingly, in the thixotropically molded product, a good balance can be achieved between the characteristics derived from Mg and the characteristics derived from SiC. That is, it is possible to obtain a thixotropically molded product in which high specific strength and specific rigidity derived from Mg are further enhanced. The ratio of the silicon carbide particles 14 is preferably 2.0 mass % or more and 25.0 mass % or less, and more preferably 5.0 mass % or more and 20.0 mass % or less.

In addition, when the ratio of the silicon carbide particles 14 is less than the lower limit value, the specific strength and the specific rigidity of the produced thixotropically molded product cannot be sufficiently enhanced. On the other hand, when the ratio of the silicon carbide particles 14 is more than the above upper limit value, the silicon carbide particles 14 are excessive, and thus the mechanical strength of the produced thixotropically molded product decreases, leading to a decrease in specific strength and also a decrease in elongation.

The coating portion 12 may contain a substance other than the silicon carbide particles 14. In this case, a content of the substance other than the silicon carbide particles 14 may be less than the content of the silicon carbide particles 14 in terms f mass ratio, and is preferably 30 mass % or less, and more preferably 10 mass % or less of the silicon carbide particles 14.

The silicon carbide particles 14 may be subjected to any surface treatment as necessary. Examples of the surface treatment include a plasma treatment, a corona treatment, an ozone treatment, an ultraviolet irradiation treatment, a roughening treatment, and a coupling agent treatment.

2.3. Bonding Portion

The bonding portion 13 includes the interposed particles 15 in the form of particles. As shown in FIG. 3, the interposed particles 15 penetrate between the metal body 11 and the silicon carbide particles 14 and between the silicon carbide particles 14, and act to bond them.

The interposed particles 15 have an average particle diameter smaller than that of the silicon carbide particles 14. Since such interposed particles 15 are minute, the interposed particles 15 easily enter between the metal body 11 and the silicon carbide particles 14 or between the silicon carbide particles 14. It is considered that the interposed particles 15 strongly interact with both the metal body 11 and the silicon carbide particles 14 since the interposed particles 15 have a very large specific surface area. Examples of the interaction include an intermolecular force such as a hydrogen bond and a Van Der Waals force, and an anchor effect caused by an aggregate of the interposed particles 15 entering irregularities present on the surface of the metal body 11. In addition, hydroxy groups are often present in a high density on surfaces of the interposed particles 15 made of an inorganic material. The hydroxy group forms a hydrogen bond with the metal body 11 and the silicon carbide particles 14, which is considered to be a driving force for the interaction. Due to such interaction, the bonding portion 13 has a function of fixing the silicon carbide particles 14 to the surface of the metal body 11.

Since the interposed particles 15 firmly fix the metal body 11 and the silicon carbide particles 14, the silicon carbide particles 14 are less likely to fall off. Therefore, when the thixotropic molding material 10 is charged into the heating cylinder 7 during the thixotropic molding, the semi-molten material of the metal body 11 and the silicon carbide particles 14 are likely to be uniformly mixed. Accordingly, the silicon carbide particles 14 and the interposed particles 15 can be uniformly dispersed in the thixotropically molded product.

The interposed particles 15 are particles made of an inorganic material. Examples of the inorganic material include oxides such as silicon oxide, aluminum oxide, and zirconium oxide, various nitrides, and various carbides. Among these, the oxide in particular has hydroxy groups in a high density on the surfaces of the interposed particles 15. The hydroxy group forms a hydrogen bond with the metal body 11 and the silicon carbide particles 14, which is considered to be a driving force for the interaction. Due to such interaction, the bonding portion 13 has a function of fixing the silicon carbide particles 14 to the surface of the metal body 11.

The oxide is less likely to vaporize and is less likely to have a bad influence on the characteristics of the thixotropically molded product even when incorporated into the thixotropically molded product. Therefore, occurrence of molding defects due to vaporization is prevented, and a thixotropically molded product having excellent characteristics is obtained.

The oxide is particularly preferably a silicon oxide. The silicon oxide combines with magnesium to form a compound and functions as a reinforcing material that reinforces the mechanical properties of the thixotropically molded product. Therefore, by using the interposed particles 15 containing the silicon oxide, it is possible to obtain the thixotropic molding material 10 with which a thixotropically molded product having excellent mechanical properties while preventing the occurrence of molding defects due to the vaporization can be produced.

In addition, the silicon oxide acts to enhance wettability between the silicon carbide particles 14 and the semi-molten material of the metal body 11 during the thixotropic molding. That is, since the interposed particles 15 are present adjacent to the silicon carbide particles 14 in the thixotropic molding material 10, the interposed particles 15 are interposed between the silicon carbide particles 14 and the metal body 11, thereby enhancing the affinity therebetween. Accordingly, in the produced thixotropically molded product, adhesion between the site derived from the silicon carbide particles 14 and the site derived from the metal body 11 can be enhanced. As a result, it is possible to produce a thixotropically molded product which is denser and excellent in mechanical properties.

In the present specification, the "silicon oxide" refers to a substance represented by a composition formula of $SiO_x$ ($0<x\leq 2$).

Containing the silicon oxide as a main component refers to that, when the elemental analysis is performed on the interposed particles 15, a content of one of Si and O is the highest and a content of the other is the second highest in terms of atomic ratio. For the elemental analysis, for example, a qualitative and quantitative analysis based on an energy dispersive X-ray spectroscopy (EDX) is used. A total content of Si and O in the interposed particles 15 may be higher than that of other elements, and is preferably more than 50 atomic %, more preferably 60 atomic % or more, and still more preferably 80 atomic % or more.

The interposed particles 15 may contain impurities in addition to the inorganic material described above. An allowable amount of the impurities is preferably 30 mass % or less, and more preferably 10 mass % or less of the interposed particles 15. Accordingly, inhibition of the effect due to the impurities is sufficiently reduced.

When the interposed particles 15 contain the silicon oxide, the silicon oxide may be crystalline, and is preferably amorphous. So-called amorphous silica is distributed under names of colloidal silica, fumed silica, or the like, and has a stable quality. Therefore, by using the interposed particles 15 containing the amorphous silica, it is possible to form the bonding portion 13 containing few coarse particles. As a result, the thixotropic molding material 10 that enables stable thixotropic molding is obtained.

As described above, it is sufficient that the average particle diameter of the interposed particles 15 is smaller than the average particle diameter of the silicon carbide particles 14. Specifically, the average particle diameter of the interposed particles 15 is preferably 20% or less, more preferably 10% or less, and still more preferably 5% or less of the average particle diameter of the silicon carbide particles 14. Accordingly, the interposed particles 15 are particularly likely to enter between the metal body 11 and the silicon carbide particles 14 and between the silicon carbide particles 14. The specific surface area of the interposed particles 15 is also particularly large.

The lower limit value may not necessarily be set, and is preferably 0.01% or more, more preferably 0.05% or more, and still more preferably 0.10% or more of the silicon carbide particles 14 from the viewpoint of easy aggregation of the interposed particles 15 and difficulty in handling of the interposed particles 15.

The average particle diameter of the interposed particles 15 is preferably 1 nm or more and 100 nm or less, more preferably 10 nm or more and 80 nm or less, and still more preferably 20 nm or more and 60 nm or less. When the average particle diameter is within the above range, the interposed particles 15 are particularly likely to enter between the metal body 11 and the silicon carbide particles 14 or between the silicon carbide particles 14. The specific surface area of the interposed particles 15 is also particularly large. Further, when the average particle diameter is within the above range, aggregation of the interposed particles 15 is prevented.

The average particle diameter of the interposed particles 15 is a value obtained by measuring an intermediate value between a length of a major axis and a length of a minor axis of the interposed particles 15 as the particle diameter from an observation image of the interposed particles 15 magnified and observed with a microscope and averaging 100 or more pieces of measurement data. As the microscope, for example, a field emission scanning electron microscope or a transmission electron microscope is preferably used.

An addition amount of the interposed particles 15 is preferably 0.5 parts by mass or more and 10.0 parts by mass or less, more preferably 1.0 parts by mass or more and 8.0 parts by mass or less, and still more preferably 3.0 parts by mass or more and 6.0 parts by mass or less, when a total mass of the metal body 11 and the silicon carbide particles 14 is 100 parts by mass. By setting the addition amount of the interposed particles 15 within the above range, it is possible to sufficiently secure a bonding function by the interposed particles 15 and to prevent generation of the excess interposed particles 15. When the addition amount of the interposed particles 15 is less than the above lower limit value, the interposed particles 15 are insufficient, and thus the silicon carbide particles 14 may fall off from the metal body 11 depending on a surface state or the like of the metal body 11. On the other hand, when the addition amount of the interposed particles 15 is more than the above upper limit value, the interposed particles 15 are excessive, and thus the mechanical properties of the thixotropically molded product may decrease, or an effect due to the addition of the silicon carbide particles 14 may decrease.

The interposed particles 15 may be subjected to any surface treatment as necessary. Examples of the surface treatment include a plasma treatment, a corona treatment, an ozone treatment, an ultraviolet irradiation treatment, a roughening treatment, and a coupling agent treatment.

The bonding portion 13 may contain a substance other than the interposed particles 15. In this case, a content of the substance other than the interposed particles 15 may be less than the content of the interposed particles 15 in terms of mass ratio, and is preferably 10 mass % or less, and more preferably 5 mass % or less of the interposed particles 15.

Examples of the substance other than the interposed particles 15 include a resin. The resin increases a bonding force of the bonding portion 13. In addition, by using the interposed particles 15 and the resin in combination, it is possible to obtain the above-described effect while reducing an amount of the resin to be used.

Examples of the resin include various resins such as a polyolefin, an acrylic resin, a styrene-based resin, a polyester, a polyether, polyvinyl alcohol, polyvinyl pyrolidone, and a copolymer thereof, waxes, alcohols, higher fatty acids, fatty acid metals, higher fatty acid esters, higher fatty acid amides, nonionic surfactants, and silicone-based lubricants.

Examples of the polyolefin include a polyethylene, a polypropylene, and an ethylene-vinyl acetate copolymer. Examples of the acrylic resin include polymethyl methacrylate and polybutyl methacrylate. Examples of the styrene-based resin include a polystyrene. Examples of the polyester include polyvinyl chloride, polyvinylidene chloride, polyamide, polyethylene terephthalate, and polybutylene terephthalate.

The resin may be a mixture containing at least one of the above components and another component, or may be a mixture containing two or more of the above components.

Among these, the resin preferably contains waxes, and more preferably contains a paraffin wax or a derivative thereof. The wax has good binding capacity.

Examples of the waxes include natural waxes such as a plant wax, an animal wax and a mineral wax, synthetic waxes such as a synthetic hydrocarbon, a modified wax, a hydrogenated wax, a fatty acid, an acid amide, and an ester.

Examples of the plant wax include a candelilla wax, a carnauba wax, a rice wax, a Japan wax, and jojoba oil. Examples of the animal wax include a beeswax, lanolin, and spermaceti. Examples of the mineral wax include a montan wax, ozokerite, and ceresin.

Examples of the synthetic hydrocarbon include a polyethylene wax. Examples of the modified wax include montan wax derivatives, paraffin wax derivatives, and microcrystalline wax derivatives. Examples of the hydrogenated wax include hardened castor oil and hardened castor oil derivatives. Examples of the fatty acid include 12-hydroxystearic acid. Examples of the acid amide include stearic acid amides. Examples of the ester include phthalic anhydride ester.

2.4. Effects of First Embodiment

As described above, the thixotropic molding material 10 according to the first embodiment includes the metal body 11, the silicon carbide particles 14, and the interposed particles 15. The metal body 11 contains Mg as a main component. The silicon carbide particles 14 adhere to the surface of the metal body 11, and contain SiC as a main component. The interposed particles 15 are interposed between the metal body 11 and the silicon carbide particles 14 and are made of an inorganic material. Further, a ratio of the silicon carbide particles 14 to a total of the metal body 11 and the silicon carbide particles 14 is 1.0 mass % or more and 30.0 mass % or less.

In such a thixotropic molding material 10, siC as a main component of the silicon carbide particles 14 has high yield strength and elastic modulus. In addition, refinement of the Mg crystals is achieved with the silicon carbide particles 14. Therefore, in the thixotropically molded product produced using the thixotropic molding material 10, high specific strength and specific rigidity derived from Mg can be further enhanced.

The interposed particles 15 act to enhance wettability between the silicon carbide particles 14 and the semi-molten material of the metal body 11 during the thixotropic molding. Accordingly, in the produced thixotropically molded product, affinity and adhesion between the site derived from the silicon carbide particles 14 and the site derived from the metal body 11 can be enhanced. As a result, it is possible to produce a thixotropically molded product which is denser and has enhanced mechanical strength.

The inorganic material is preferably a silicon oxide. The silicon oxide combines with magnesium to form a compound, and can enhance the mechanical properties of the thixotropically molded product. In addition, the silicon oxide acts to enhance wettability between the silicon carbide particles 14 and the semi-molten material of the metal body 11 during the thixotropic molding. Accordingly, it is possible to produce a thixotropically molded product which is denser and excellent in mechanical properties.

The average particle diameter of the silicon carbide particles 14 is preferably 0.3 μm or more and 20 μm or less.

Accordingly, when the silicon carbide particles 14 adhere to the surface of the metal body 11, the silicon carbide particles 14 can be uniformly distributed, and the silicon carbide particles 14 are less likely to fall off. As a result, a thixotropically molded product in which sites derived from the silicon carbide particles 14 are satisfactorily dispersed can be produced.

3. Second Embodiment

Next, a method of producing a thixotropic molding material according to a second embodiment will be described. In the following description, a method of producing the above-described thixotropic molding material 10 will be described as an example.

Figure 4:
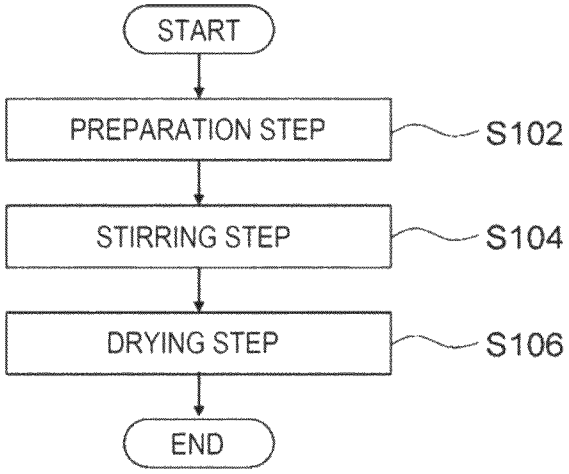
FIG. 4 is a step diagram showing a method of producing a thixotropic molding material according to a second embodiment.

FIG. 4 is a step diagram showing the method of producing the thixotropic molding material 10 according to the second embodiment.

The method of producing the thixotropic molding material 10 shown in FIG. 4 includes a preparation step S102, a stirring step S104, and a drying step S106.

3.1. Preparation Step

In the preparation step S102, a mixture containing the metal body 11, the silicon carbide particles 14, the interposed particles 15, and a dispersion medium is prepared. The mixture is a dispersion liquid in which the metal body 11, the silicon carbide particles 14, and the interposed particles 15 are dispersed using a sufficient amount of dispersion medium.

The dispersion medium is not particularly limited as long as the dispersion medium does not modify the metal body 11, the silicon carbide particles 14, and the interposed particles 15. Examples of the dispersion medium include water, isopropyl alcohol, and acetone. In this step, a mixture produced in advance may be prepared. By containing water in the dispersion medium, it is possible to introduce hydroxy groups in a higher density to the surfaces of the metal body 11, the silicon carbide particles 14, and the interposed particles 15.

As described above, the average particle diameter of the silicon carbide particles 14 contained in the thixotropic molding material 10 is preferably 20 μm or less. Accordingly, in the stirring step S104 to be described later, adhesion of the silicon carbide particles 14 to the metal body 11 can be enhanced. As a result, the thixotropic molding material 10 having a stable quality can be produced, and finally, a thixotropically molded product in which the silicon carbide particles 14 are satisfactorily dispersed can be obtained.

In addition, as described above, the ratio of the silicon carbide particles 14 to the total of the metal body 11 and the silicon carbide particles 14 is 1.0 mass % or more and 30.0 mass % or less. By setting the ratio of the silicon carbide particles 14 within the above range, the silicon carbide particles 14 are less likely to fall off from the metal body 11. In addition, a ratio of the site derived from the metal body 11 to the site derived from the silicon carbide particles 14 can be optimized in the produced thixotropically molded product.

3.2. Stirring Step

In the stirring step S104, the mixture is stirred. For stirring, for example, a method of using a stirring rod or a stirring bar, or a method of shaking a container containing a mixture in a state of being covered with a lid is used. By such stirring, the silicon carbide particles 14 can adhere to the surface of the metal body 11 via the interposed particles 15. A part of the silicon carbide particles 14 may directly adhere to the surface of the metal body 11 without the interposed particles 15 interposed therebetween. At this stage, the silicon carbide particles 14 may adhere to the surface of the metal body 11 with a weak adhesive force. In addition, by stirring, aggregation of the metal body 11, aggregation of the silicon carbide particles 14, and aggregation of the interposed particles 15 can be prevented.

3.3. Drying Step

In the drying step S106, the mixture is dried. Accordingly, the silicon carbide particles 14 adhering to the surface of the metal body 11 via the interposed particles 15 adhere to the metal body 11 more firmly. For example, when hydroxy groups present on the surfaces of the interposed particles 15 and hydroxy groups present on the surfaces of the metal body 11 or the silicon carbide particles 14 are bonded to each other by a weak adhesive force due to a hydrogen bond or the like, dehydration shrinkage occurs through this step, and the silicon carbide particles 14 and the metal body 11 are bonded to each other by a stronger adhesive force. For example, silanol groups are present on the surfaces of the interposed particles 15. Through this step, the dehydration shrinkage occurs in the silanol groups, siloxane bonds are generated between the interposed particles 15, and the interposed particles 15 act like an adhesive. In this way, the silicon carbide particles 14 are fixed to the metal body 11. When a resin is added to the mixture, the resin is melted by heating in the drying step S106 and solidified, and the silicon carbide particles 14 are fixed.

In addition, the dispersion medium contained in the mixture can be sufficiently removed by drying. Accordingly, a vaporized component is sufficiently removed, and the thixotropic molding material 10 capable of preventing occurrence of molding defects due to vaporization during thixotropic molding is obtained. According to such a thixotropic molding material 10, it is possible to produce a dense thixotropically molded product with few pores.

For drying, a method of heating the mixture, a method of exposing the mixture to a gas, or the like is used. Among these, in the case of heating the mixture, for example, the entire container containing the mixture may be heated using a hot bath or the like. In the drying step S106, all the dispersion medium in the mixture may be removed, or a part of the dispersion medium may remain without being removed.

As described above, the thixotropic molding material 10 is obtained. When the mixture contains a resin, a degreasing treatment may be performed on the thixotropic molding material 10 after the drying step S106.

3.4. Effects of Second Embodiment

As described above, the method of producing the thixotropic molding material according to the embodiment includes the preparation step S102, the stirring step S104, and the drying step S106. In the preparation step S102, a mixture containing the metal body 11 containing Mg as a main component, the silicon carbide particles 14 containing SiC as a main component, the interposed particles 15 made of an inorganic material, and a dispersion medium is prepared. In the stirring step S104, the mixture is stirred. In the drying step S106, the silicon carbide particles 14 adhere to the surface of the metal body 11 via the interposed particles 15 by removing at least a part of the dispersion medium from the stirred mixture. Further, in the mixture, the ratio of the silicon carbide particles 14 to the total of the metal body 11 and the silicon carbide particles 14 is 1.0 mass % or more and 30.0 mass % or less.

According to such a production method, since the metal body 11 and the silicon carbide particles 14 are more firmly fixed to each other via the interposed particles 15, it is possible to produce the thixotropic molding material 10 in which the silicon carbide particles 14 are less likely to fall off. In such a thixotropic molding material 10, the silicon carbide particles 14 and the interposed particles 15 can be uniformly dispersed during the thixotropic molding. As a result, refinement of the Mg crystals can be achieved in the entire thixotropically molded product. Accordingly, in the thixotropically molded product produced using the thixotropic molding material 10, high specific strength and specific rigidity derived from Mg can be further enhanced.

4. Third Embodiment

Next, a thixotropically molded product according to a third embodiment will be described.

Figure 5:
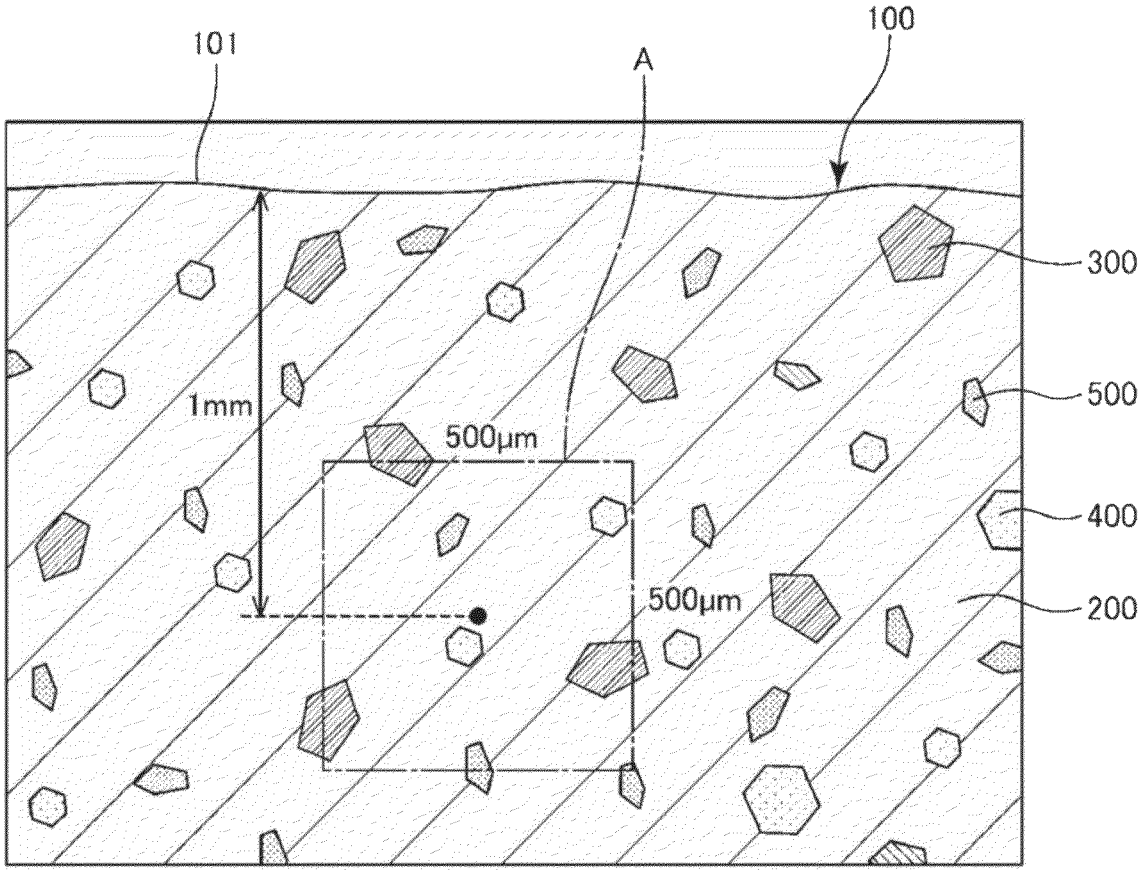
FIG. 5 is a partial cross-sectional view schematically showing a thixotropically molded product according to a third embodiment.

FIG. 5 is a partial cross-sectional view schematically showing a thixotropically molded product 100 according to the third embodiment.

The thixotropically molded product 100 shown in FIG. 5 has a matrix portion 200, and first particle portions 300, second particle portions 400, and third particle portions 500 dispersed in the matrix portion 200. Shapes and distribution states of the first particle portions 300, the second particle portions 400, and the third particle portions 500 shown in FIG. 5 are schematic.

The matrix portion 200 contains Mg as a main component. The first particle portions 300 contain SiC as a main component. The second particle portions 400 contain $Mg_2Si$ as a main component. The third particle portions 500 contain MgO as a main component. Further, an area fraction of the first particle portions 300 in a cross section of the thixotropically molded product 100 is 0.6% or more and 19.6% or less.

In such a thixotropically molded product 100, refinement of the Mg crystals can be achieved with the first particle portions 300. Accordingly, high specific strength and specific rigidity derived from the matrix portion 200 can be further enhanced.

In addition, the second particle portions 400 and the third particle portions 500 also contribute to the refinement of the Mg crystals. At least a part of $Mg_2Si$ or MgO is distributed to be adjacent to the first particle portions 300. Accordingly, wettability between the first particle portions 300 and the matrix portion 200 can be enhanced. As a result, the thixotropically molded product 100 is dense and is particularly excellent in mechanical properties.

4.1. Matrix Portion

The matrix portion 200 contains Mg as a main component. Containing Mg as a main component refers to that, when elemental analysis is performed on a cross section of the matrix portion 200, a content of Mg is the highest in terms of atomic ratio. For the elemental analysis, for example, a qualitative and quantitative analysis based on an energy dispersive X-ray spectroscopy (EDX) is used. The content of Mg in the matrix portion 200 may be higher than that of other elements, and is preferably more than 50 atomic %, more preferably 70 atomic % or more, and still more preferably 80 atomic % or more. During identification of the matrix portion 200 in the qualitative and quantitative analysis, the matrix portion 200 can be distinguished based on a contrast with other sites or a color tone in, for example, an observation image from a scanning electron microscope or an optical microscope. The matrix portion 200 may contain additives or impurities other than Mg.

The matrix portion 200 occupies the highest area fraction in the cross section of the thixotropically molded product 100. Therefore, the matrix portion 200 has a dominant influence on the mechanical properties of the thixotropically molded product 100. Accordingly, high specific rigidity and high specific strength of Mg are reflected in the thixotropically molded product 100.

The matrix portion 200 is a site derived from the metal body 11, for example, when the matrix portion 200 is produced using the above-described thixotropic molding material 10. In this case, the matrix portion 200 is a site having a composition substantially the same as that of the metal body 11.

An average particle diameter of the Mg crystals in the thixotropically molded product 100 is preferably 1.0 μm or more and 8.0 μm or less, more preferably 2.0 μm or more and 7.0 μm or less, and still more preferably 3.0 μm or more and 6.0 μm or less.

When the average particle diameter of the Mg crystals is within the above range, a movement of dislocation is particularly less likely to occur at a grain boundary of the Mg crystals. Therefore, the mechanical strength and the rigidity of the thixotropically molded product 100 can be particularly enhanced.

The Mg crystals can be identified on an image by performing crystal orientation analysis (EBSD analysis) on a cut surface of the matrix portion 200. Accordingly, an intermediate value between a length of a major axis and a length of a minor axis of the Mg crystals identified on the image can be set as a particle diameter of the Mg crystals. The average particle diameter of the Mg crystals can be obtained by averaging 100 or more measured particle diameters.

4.2. First Particle Portion (SiC)

The first particle portions 300 contain Sic as a main component. Containing SiC as a main component refers to that, when elemental analysis is performed on cross sections of the first particle portions 300, a content of one of Si and C is the highest and a content of the other is the second highest in terms of atomic ratio. For the elemental analysis, for example, a qualitative and quantitative analysis based on an energy dispersive X-ray spectroscopy (EDX) is used. A total content of Si and C in the first particle portions 300 may be higher than that of other elements, and is preferably more than 50 atomic %, and more preferably 60 atomic % or more. During the identification of the first particle portions 300 in the qualitative and quantitative analysis, the first particle portions 300 can be distinguished based on a contrast with other sites or a color tone in, for example, an observation image from a scanning electron microscope or an optical microscope. The first particle portions 300 may contain additives or impurities other than SiC.

In the observation image of the cross section of the thixotropically molded product 100 shown in FIG. 5, a range A of 500 μm square is set around a point at a depth of 1 mm from a surface 101. A proportion of an area of the first particle portions 300 to an area of the range A is defined as an area fraction of the first particle portions 300. Since the range A is a region set to a sufficient depth, it can be considered that the range A represents an average structure of the thixotropically molded product 100.

At this time, the area fraction described above is 0.6% or more and 19.6% or less. By setting the area fraction within the above range, the above-described effect by the first particle portions 300, specifically, the effect of further enhancing high specific strength and specific rigidity derived from Mg can be obtained. Therefore, when the area fraction is less than the above lower limit value, the first particle portions 300 are insufficient, and thus the above-described effect cannot be obtained. On the other hand, when the area fraction is more than the above upper limit value, the first particle portions 300 are excessive, and the specific strength of the thixotropically molded product 100 decreases. The area fraction is preferably 1.0% or more and 15.0% or less, and more preferably 2.0% or more and 10.0% or less.

The area fraction in the range A is calculated as follows. First, a range of the first particle portions 300 is extracted by image processing in the range A. For the image processing, for example, image analysis software OLYMPUS Stream or the like can be used. A magnification of the observation image is preferably 300 times or more. Next, a proportion of the area of the first particle portion 300 to the entire area of the range A is calculated. The proportion is defined as the area fraction.

An average particle diameter of the first particle portions 300 is preferably 0.3 μm or more and 20.0 μm or less, and more preferably 3.0 μm or more and 15.0 μm or less. Accordingly, the first particle portions 300 are less likely to become a starting point of breakage, and mechanical strength of the thixotropically molded product 100 can be enhanced without impairing the rigidity of the matrix portion 200.

The average particle diameter of the first particle portions 300 is calculated as follows. First, a length of a major axis and a length of a minor axis of each of the first particle portions 300 included in the range A are determined. Next, an intermediate value between the length of the minor axis and the length of the major axis is determined. An average value of the intermediate values calculated in this manner is the average particle diameter of the first particle portions 300.

An average aspect ratio of the first particle portions 300 is preferably 3.0 or less, more preferably 2.5 or less, and still more preferably 2.0 or less. When the average aspect ratio of the first particle portions 300 is within the above range, anisotropy of structures of the first particle portions 300 is reduced. Therefore, the mechanical strength and the rigidity of the thixotropically molded product 100 can be isotropically enhanced.

The average aspect ratio of the first particle portions 300 is calculated as follows. First, a length of a major axis and a length of a minor axis of each of the first particle portions 300 included in the range A are determined. Next, a ratio of the length of the major axis to the length of the minor axis is referred to as an "aspect ratio". An average value of the aspect ratios calculated in this manner is the average aspect ratio of the first particle portions 300.

4.3. Second Particle Portion ($Mg_2Si$)

The second particle portions 400 contain $Mg_2Si$ as a main component, and have a particulate shape. $Mg_2Si$ has a tensile elastic modulus (Young's modulus) higher than that of the matrix portion 200. Therefore, the second particle portions 400 function as a reinforcing material for enhancing the rigidity of the thixotropically molded product 100. Accordingly, the thixotropically molded product 100 has higher rigidity.

Containing $Mg_2Si$ as a main component refers to that, when elemental analysis is performed on cross sections of the second particle portions 400, a content of Mg is the highest and a content of Si is the second highest in terms of atomic ratio. For the elemental analysis, for example, a qualitative and quantitative analysis based on an energy dispersive X-ray spectroscopy (EDX) is used. A total content of Mg and Si in the second particle portions 400 may be higher than that of other elements, and is preferably more than 50 atomic %, and more preferably 60 atomic or more. During the identification of the second particle portions 400 in the qualitative and quantitative analysis, the second particle portions 400 can be distinguished based on a contrast with the matrix portion 200 and other sites or a color tone in, for example, an observation image from a scanning electron microscope or an optical microscope. The second particle portions 400 may contain additives or impurities other than $Mg_2Si$.

The second particle portions 400 also have a function of preventing coarsening of the Mg crystals contained in the matrix portion 200. Therefore, in the thixotropically molded product 100, refinement of the Mg crystals in the matrix portion 200 is achieved. Accordingly, the thixotropically molded product 100 has high mechanical strength.

An average particle diameter of the second particle portions 400 is preferably 10.0 μm or less, more preferably 0.1 μm or more and 8.0 μm or less, and still more preferably 0.3 μm or more and 5.0 μm or less. Accordingly, the second particle portions 400 can effectively contribute to the refinement of the Mg crystals and can be prevented from becoming a starting point of breakage. As a result, the specific strength and the specific rigidity of the thixotropically molded product 100 can be particularly enhanced.

The average particle diameter of the second particle portions 400 is calculated as follows. First, a length of a major axis and a length of a minor axis of each of the second particle portions 400 included in the range A are determined. Next, an intermediate value between the length of the minor axis and the length of the major axis is determined. An average value of the intermediate values calculated in this manner is the average particle diameter of the second particle portions 400.

A cross-sectional shape of the second particle portion 400 is not particularly limited and may be any shape, and an average aspect ratio thereof is preferably less than 2.0, and more preferably 1.5 or less. Accordingly, the second particle portions 400 are less likely to become a starting point that causes a crack in the thixotropically molded product 100, and thus an effect of enhancing the mechanical strength of the thixotropically molded product 100 is obtained. In addition, the effect of preventing coarsening of the Mg crystals is more remarkable.

An aspect ratio of the second particle portions 400 is a ratio of a length to a width of the second particle portions 400 in the cross section of the thixotropically molded product 100. The length is a maximum length that can be taken in a cross section of the second particle portion 400, and the width is a maximum length in a direction orthogonal to a direction of the maximum length. Then, ten second particle portions 400 are randomly extracted from the observation image of the cross section of the thixotropically molded product 100, and an average value of the aspect ratios of the second particle portions is the average aspect ratio. For example, an optical microscope or an electron microscope is used to acquire the observation image.

In addition, as described above, the second particle portions 400 also contribute to enhancing the wettability between the first particle portions 300 and the matrix portion 200. Accordingly, voids and the like are less likely to be generated between the first particle portions 300 and the matrix portion 200, and the thixotropically molded product 100 can be made denser.

4.4. Third Particle Portion (MgO)

The third particle portions 500 contain MgO as a main component, and have a particulate shape. MgO has a tensile elastic modulus (Young's modulus) higher than that of the matrix portion 200. Therefore, the third particle portions 500 function as a reinforcing material for enhancing the rigidity of the thixotropically molded product 100. Accordingly, the thixotropically molded product 100 has higher rigidity.

Containing MgO as a main component refers to that, when elemental analysis is performed on cross sections of the third particle portions 500, a content of one of Mg and O is the highest and a content of the other is the second highest in terms of atomic ratio. For the elemental analysis, for example, a qualitative and quantitative analysis based on an energy dispersive X-ray spectroscopy (EDX) is used. A total content of Mg and O in the third particle portions 500 may be higher than that of other elements, and is preferably more than 50 atomic %, and more preferably 60 atomic % or more. During the identification of the third particle portions 500 in the qualitative and quantitative analysis, the third particle portions 500 can be distinguished based on a contrast with the matrix portion 200 and other sites or a color tone in, for example, an observation image from a scanning electron microscope or an optical microscope. The third particle portions 500 may contain additives or impurities other than MgO.

In addition, the third particle portions 500 have a function of preventing coarsening of the Mg crystals contained in the matrix portion 200. Therefore, in the thixotropically molded product 100, refinement of the Mg crystals in the matrix portion 200 is achieved. Accordingly, the thixotropically molded product 100 has high mechanical strength.

Further, the third particle portions 500 also have a function of inhibiting abnormal growth of the second particle portion 400 in a branch shape or a needle shape. Due to the function, the second particle portion 400 tends to have an isotropic shape, and an increase in the average aspect ratio is prevented.

In addition, as described above, the third particle portions 500 also contribute to enhancing the wettability between the first particle portions 300 and the matrix portion 200. Therefore, at least a part of the third particle portions 500 are preferably adjacent to the first particle portions 300. Accordingly, voids and the like are less likely to be generated between the first particle portions 300 and the matrix portion 200, and the thixotropically molded product 100 can be made denser.

An average particle diameter of the third particle portions 500 is preferably smaller than the average particle diameter of the second particle portions 400, and is more preferably 1% or more and 60% or less, and still more preferably 3% or more and 40% or less of the average particle diameter of the second particle portions 400. Accordingly, the third particle portion 500 exerts the above-described function without becoming a starting point of breakage or inhibiting the function of the first particle portions 300 or the second particle portions 400. As a result, the specific strength and the specific rigidity of the thixotropically molded product 100 can be particularly enhanced.

The average particle diameter of the third particle portions 500 is calculated as follows. First, a length of a major axis and a length of a minor axis of each of the third particle portions 500 included in the range A are determined. Next, an intermediate value between the length of the minor axis and the length of the major axis is determined. An average value of the intermediate values calculated in this manner is the average particle diameter of the third particle portions 500.

A total area of the second particle portions 400 and the third particle portions 500 in the cross section of the thixotropically molded product 100 is preferably 1.0 or more and 30.0 or less, more preferably 2.0 or more and 25.0 or less, and still more preferably 3.0 or more and 20.0 or less, when the area of the first particle portions 300 is 100. Accordingly, the above-described effects of the second particle portions 400 and the third particle portions 500 can be obtained without impairing the effect of the first particle portions 300. That is, it is possible to improve a balance of an existence ratio of the first particle portions 300, the second particle portions 400, and the third particle portions 500. As a result, the mechanical properties of the thixotropically molded product 100 can be particularly enhanced.

4.5. Physical Properties of Thixotropically Molded Product

Tensile strength of the thixotropically molded product 100 is preferably 170 MPa or more and 350 MPa or less, and more preferably 200 MPa or more and 300 MPa or less. A Young's modulus of the thixotropically molded product 100 is preferably 40 GPa or more and 80 GPa or less, and more preferably 44 GPa or more and 70 GPa or less.

The thixotropically molded product 100 in which the tensile strength and the Young's modulus are within the above ranges has particularly high specific strength and specific rigidity, and can be stably produced. Since such a thixotropically molded product 100 is lightweight and is excellent in mechanical properties, the thixotropically molded product 100 is suitable for, for example, a component used for a transportation device such as an automobile and an aircraft, and a component used in a mobile device such as a mobile terminal and a notebook computer.

The tensile strength of the thixotropically molded product 100 is measured as follows. First, a test piece is cut out from the thixotropically molded product 100. Examples of the test piece include a No. 13 test piece defined in JIS. Next, the test piece is attached to a tensile tester, and a stress corresponding to a maximum force applied to the test piece at 25° C. is calculated. The obtained stress is defined as the tensile strength of the thixotropically molded product 100.

The Young's modulus of the thixotropically molded product 100 is measured as follows. First, a test piece is cut out from the thixotropically molded product 100. Next, the test piece is attached to a tensile tester, and a tensile load is applied to the test piece at 25° C. Next, an amount of change in tensile strain when the tensile load is varied and an amount of change in tensile stress when the tensile load is varied are calculated. Then, a ratio of the latter amount of change to the former amount of change is calculated, and the obtained ratio is defined as the Young's modulus of the thixotropically molded product 100. The Young's modulus of the thixotropically molded product 100 may be a value measured by a method other than the above-described measurement method, for example, a resonance method or an ultrasonic pulse method.

Vickers hardness of the surface 101 of the thixotropically molded product 100 is preferably 80 or more and 350 or less, more preferably 90 or more and 300 or less, and still more preferably 100 or more and 250 or less. When the Vickers hardness is within the above range, it is possible to obtain the thixotropically molded product 100 having high surface hardness and being resistant to scratches and the like.

The Vickers hardness of the surface 101 of the thixotropically molded product 100 is measured according to a Vickers hardness test method defined in JIS Z 2244:2009. A measurement load is 200 gf.

A thermal conductivity of the thixotropically molded product 100 is preferably 52 W/(m·K) or more, more preferably 54 W/(m·K) or more, and still more preferably 57 W/(m·K) or more. The thixotropically molded product 100 having such a thermal conductivity can also be applied to, for example, a site where heat dissipation is required.

The thermal conductivity of the thixotropically molded product 100 is measured by, for example, a laser flash method.

4.6. Effects of Third Embodiment

As described above, the thixotropically molded product 100 according to the third embodiment includes the matrix portion 200, and the first particle portions 300, the second particle portions 400, and the third particle portions 500 dispersed in the matrix portion 200. The matrix portion 200 contains Mg as a main component. The first particle portions 300 contain SiC as a main component. The second particle portions 400 contain $Mg_2Si$ as a main component. The third particle portions 500 contain MgO as a main component. Further, an area fraction of the first particle portions 300 in a cross section of the thixotropically molded product 100 is 0.6% or more and 19.6% or less.

According to such a configuration, the first particle portions 300 function as a reinforcing material, and refinement of the Mg crystals can be achieved. Accordingly, it is possible to obtain the thixotropically molded product 100 in which high specific strength and specific rigidity derived from the matrix portion 200 are further enhanced by the first particle portions 300.

In addition, the second particle portions 400 and the third particle portions 500 also contribute to the refinement of the Mg crystals. At least a part of $Mg_2Si$ or MgO is distributed to be adjacent to the first particle portions 300. Accordingly, the wettability between the first particle portions 300 and the matrix portion 200 can be enhanced. As a result, the thixotropically molded product 100 is dense and is particularly excellent in mechanical properties.

The total area of the second particle portions 400 and the third particle portions 500 in the cross section of the thixotropically molded product 100 is preferably 1.0 or more and 30.0 or less, when the area of the first particle portions 300 is 100. Accordingly, the mechanical properties of the thixotropically molded product 100 can be particularly enhanced.

The average particle diameter of the first particle portions 300 is preferably 0.3 μm or more and 20.0 μm or less. The average particle diameter of the second particle portions 400 is preferably 10.0 μm or less. The average particle diameter of the third particle portions 500 is preferably smaller than the average particle diameter of the second particle portions 400.

Accordingly, in the thixotropically molded product 100, the first particle portions 300, the second particle portions 400, and the third particle portions 500 are less likely to become a starting point of breakage, and contribute to the refinement of the Mg crystals. Therefore, the specific strength and the specific rigidity of the thixotropically molded product 100 can be particularly enhanced.

The thixotropically molded product, the thixotropic molding material, and the method of producing the thixotropic molding material according to the present disclosure are described above based on the shown embodiments, and the present disclosure is not limited to the above-described embodiments. For example, the thixotropic molding material and the thixotropically molded product according to the present disclosure may be those obtained by adding any components to the above-described embodiments. The method of producing the thixotropic molding material according to the present disclosure may be a method in which any step is added to the above-described embodiments.

EXAMPLES

Next, specific Examples of the present disclosure will be described.

5. Production of Thixotropic Molding Material 5.1. Sample No. 1

First, a magnesium alloy chip as a metal body, a SiC powder as silicon carbide particles, a silica powder as interposed particles, and IPA (isopropyl alcohol) as a dispersion medium were mixed to obtain a mixture. A chip of 4 mm×2 mm×1 mm made of an AZ91D alloy manufactured by Nippon Materials Co., Ltd. was used as the magnesium alloy chip. The AZ91D alloy is an Mg-based alloy containing 9 mass % of Al and 1 mass % of Zn. Colloidal silica (amorphous silica) obtained by colloidal dispersion in IPA was used as the silica powder. Production conditions for other thixotropic molding materials are as shown in Table 1.

Next, the mixture was stirred. A method of shaking a container containing the mixture was used for stirring.

Next, the stirred mixture was heated and dried. Accordingly, a thixotropic molding material was obtained.

5.2. Sample Nos. 2 to 8

A thixotropic molding material was obtained in the same manner as in the case of Sample No. 1 except that the production conditions for the thixotropic molding material were changed as shown in Table 1. In Sample No. 10, a paraffin wax as a resin was used as a binder instead of the silica powder.

5.3. Sample No. 9

A thixotropic molding material was obtained in the same manner as in the case of Sample No. 1 except that the addition of the silicon carbide particles was omitted.

5.4. Sample No. 10

A thixotropic molding material was obtained in the same manner as in the case of Sample No. 1 except that a paraffin wax as a resin was used as a binder instead of the silica powder.

5.5. Sample Nos. 11 to 21

A thixotropic molding material was obtained in the same manner as in the case of Sample No. 1 except that the production conditions for the thixotropic molding material were changed as shown in Table 2. In sample No. 21, an alumina powder was used instead of the silica powder.

In Tables 1 and 2, among the thixotropic molding materials of respective sample Nos., those corresponding to the present disclosure are indicated by "Examples", and those not corresponding to the present disclosure are indicated by "Comparative Examples".

6. Evaluation of Thixotropic Molding Material

A sieve having an opening of 600 μm and a wire diameter of 500 μm was used to shake the thixotropic molding material of each sample No. Next, a weight was measured before and after shaking, and a weight loss amount was calculated. Then, a weight loss rate was calculated by dividing the calculated weight loss amount by an original weight. Based on the weight loss rate, adhesion of the silicon carbide particles in the thixotropic molding material and the particles instead of the silicon carbide particles was evaluated. Evaluation results are shown in Tables 1 and 2.

TABLE 1

| | | Production condition for thixotropic molding material | | | | | | Evaluation result of thixotropic molding material |
|---|---|---|---|---|---|---|---|---|
| | | Silicon carbide particles | | Interposed particles | | | | Adhesion of |
| Sample No. | Example/ Comparative Example | Average particle diameter μm | Addition amount mass % | Inorganic material — | Average particle diameter nm | Particle diameter ratio % | Addition amount Parts by mass | silicon carbide particles % |
| 1 | Comparative Example | 5 | 0.5 | Silicon oxide | 45 | 0.90 | 5.0 | 62 |
| 2 | Example | 5 | 1.5 | Silicon oxide | 45 | 0.90 | 5.0 | 60 |
| 3 | Example | 5 | 5.0 | Silicon oxide | 45 | 0.90 | 5.0 | 59 |
| 4 | Example | 5 | 10.0 | Silicon oxide | 45 | 0.90 | 5.0 | 58 |
| 5 | Example | 5 | 15.0 | Silicon oxide | 45 | 0.90 | 5.0 | 56 |
| 6 | Example | 5 | 20.0 | Silicon oxide | 45 | 0.90 | 5.0 | 54 |
| 7 | Example | 5 | 30.0 | Silicon oxide | 45 | 0.90 | 5.0 | 48 |
| 8 | Comparative Example | 5 | 40.0 | Silicon oxide | 45 | 0.90 | 5.0 | 30 |
| 9 | Comparative Example | — | 0.0 | Silicon oxide | 45 | — | 5.0 | — |
| 10 | Comparative Example | 5 | 10.0 | Paraffin wax 5.0 parts by mass | | | | 50 |

TABLE 2

| | | Production condition for thixotropic molding material | | | | | | Evaluation result of thixotropic molding material |
|---|---|---|---|---|---|---|---|---|
| | | Silicon carbide particles | | Interposed particles | | | | Adhesion of |
| Sample No. | Example/ Comparative Example | Average particle diameter μm | Addition amount mass % | Inorganic material — | Average particle diameter nm | Particle diameter ratio % | Addition amount Parts by mass | silicon carbide particles % |
| 11 | Example | 0.5 | 10.0 | Silicon oxide | 5 | 1.00 | 5.0 | 62 |
| 12 | Example | 3 | 10.0 | Silicon oxide | 45 | 1.50 | 5.0 | 64 |
| 13 | Example | 10 | 10.0 | Silicon oxide | 45 | 0.45 | 5.0 | 65 |
| 14 | Example | 15 | 10.0 | Silicon oxide | 20 | 0.13 | 5.0 | 62 |
| 15 | Example | 20 | 10.0 | Silicon oxide | 20 | 0.10 | 5.0 | 45 |
| 16 | Example | 5 | 10.0 | Silicon oxide | 100 | 2.00 | 5.0 | 41 |
| 17 | Example | 5 | 10.0 | Silicon oxide | 45 | 0.90 | 0.5 | 43 |
| 18 | Example | 5 | 10.0 | Silicon oxide | 45 | 0.90 | 3.0 | 58 |
| 19 | Example | 5 | 10.0 | Silicon oxide | 45 | 0.90 | 7.0 | 60 |
| 20 | Example | 5 | 10.0 | Silicon oxide | 45 | 0.90 | 10.0 | 60 |
| 21 | Example | 5 | 10.0 | Aluminum oxide | 50 | 1.00 | 6.0 | 4665 |

In each Example shown in Table 1, it is found that the adhesion of the silicon carbide particles can be sufficiently enhanced by setting the addition amount of the silicon carbide particles within a predetermined range. On the other hand, it is found that, when the addition amount of the silicon carbide particles is too large, a large amount of silicon carbide particles that cannot come into contact with the metal body are generated, resulting in a decrease in adhesion.

In each Example shown in Table 2, it is found that the adhesion of the silicon carbide particles can be sufficiently enhanced by setting the average particle diameter of the silicon carbide particles within a predetermined range. On the other hand, it is found that, when the average particle diameter of the silicon carbide particles is too large, the silicon carbide particles are likely to fall off from the metal body due to their own weight.

In addition, in each Example shown in Table 2, it is found that the adhesion of the silicon carbide particles can be sufficiently enhanced by setting the addition amount of the interposed particles within a predetermined range.

7. Analysis of Configuration of Thixotropically Molded Product

The thixotropic molding material of each sample No. was charged into an injection molding machine and subjected to thixotropic molding to obtain a thixotropically molded product. As the injection molding machine, a magnesium injection molding machine JLM75MG manufactured by The JAPAN STEEL WORKS, LTD. was used.

Next, the thixotropically molded product of each sample No. was cut, and a cut surface was observed with an optical microscope. Further, based on an observation image, the matrix portion, the first particle portions, the second particle portions, and the third particle portions were identified, and an average particle diameter was calculated.

Next, an area fraction of the first particle portions was calculated. A ratio of the total area of the second particle portions and the third particle portions to the area of the first particle portions was calculated. Calculation results are shown in Tables 3 and 4.

8. Evaluation Results of Thixotropically Molded Product

Tensile strength and tensile elastic modulus (Young's modulus) of the thixotropically molded product of each sample No. were measured. Measurement results are shown in Tables 3 and 4.

TABLE 3

| | | Configuration of thixotropically molded product | | | | | | |
|---|---|---|---|---|---|---|---|---|
| | | Area | | Average particle diameter | | | Evaluation result of thixotropically molded product | |
| Sample No. | Example/ Comparative Example | Area fraction of first particle portion % | Ratio of total area of second particle portion and third particle portion to area of first particle portion % | First particle portion μm | Second particle portion μm | Particle diameter ratio of third particle portion to second particle portion % | Tensile strength MPa | Tensile elastic modulus (Young's modulus) GPa |
| 1 | Comparative Example | 0.3 | 32.0 | 0.1 | 45.0 | 35 | 165 | 39 |
| 2 | Example | 0.8 | 20.1 | 1.2 | 1.2 | 15 | 190 | 45 |
| 3 | Example | 2.7 | 15.4 | 2.0 | 2.0 | 10 | 200 | 48 |
| 4 | Example | 5.6 | 8.1 | 3.0 | 3.0 | 9 | 200 | 49 |
| 5 | Example | 8.5 | 4.1 | 4.3 | 2.1 | 6 | 190 | 54 |
| 6 | Example | 11.7 | 3.6 | 5.8 | 1.8 | 7 | 185 | 56 |
| 7 | Example | 18.5 | 3.1 | 9.2 | 1.6 | 8 | 180 | 57 |
| 8 | Comparative Example | 26.1 | 2.8 | 13.0 | 1.4 | 5 | 160 | 60 |
| 9 | Comparative Example | 0.0 | — | 0.0 | 2.5 | 10 | 160 | 39 |
| 10 | Comparative Example | 5.6 | 0.0 | — | — | — | 140 | 37 |

TABLE 4

| | | Configuration of thixotropically molded product | | | | | Evaluation result of thixotropically molded product | |
|---|---|---|---|---|---|---|---|---|
| | | Area | | Average particle diameter | | | | |
| Sample No. | Example/ Comparative Example | Area fraction of first particle portion % | Ratio of total area of second particle portion and third particle portion to area of first particle portion % | First particle portion μm | Second particle portion μm | Particle diameter ratio of third particle portion to second particle portion % | Tensile strength MPa | Tensile elastic modulus (Young's modulus) GPa |
| 11 | Example | 4.8 | 5.8 | 0.4 | 0.2 | 28 | 195 | 58 |
| 12 | Example | 6.2 | 7.1 | 2.8 | 0.9 | 20 | 215 | 62 |
| 13 | Example | 5.4 | 6.1 | 8.6 | 1.5 | 11 | 220 | 64 |
| 14 | Example | 4.9 | 4.9 | 16.4 | 1.4 | 10 | 200 | 60 |
| 15 | Example | 7.1 | 8.6 | 19.5 | 2.2 | 9 | 175 | 48 |
| 16 | Example | 2.6 | 10.2 | 4.5 | 5.6 | 10 | 180 | 50 |
| 17 | Example | 6.1 | 3.6 | 4.1 | 1.1 | 15 | 195 | 57 |
| 18 | Example | 5.1 | 4.4 | 3.8 | 0.8 | 21 | 200 | 61 |
| 19 | Example | 5.3 | 15.4 | 4.6 | 2.6 | 8 | 215 | 63 |
| 20 | Example | 4.6 | 24.6 | 4.3 | 3.4 | 5 | 215 | 62 |
| 21 | Example | 5.6 | 5.8 | 4.2 | 1.5 | 11 | 185 | 52 |

In each Example shown in Table 3, it is found that since the area fraction of the first particle portions derived from the silicon carbide particles is within a predetermined range, the tensile strength and the tensile elastic modulus are larger than those of each Comparative Example. On the other hand, it is found that in each Comparative Example, since the area fraction of the first particle portions is zero or excessively large, the tensile strength is relatively small.

It is found that when the resin is used instead of the interposed particles, the tensile strength is decreased as compared with the case of using the interposed particles. The result is considered to be due to the fact that the resin is vaporized during the thixotropic molding and denseness of the thixotropically molded product is decreased.

What is claimed is:

1. A thixotropically molded product comprising:

a matrix portion containing Mg as a main component;

a first particle portion dispersed in the matrix portion and containing SiC as a main component;

a second particle portion dispersed in the matrix portion and containing $Mg_2Si$ as a main component; and a third particle portion dispersed in the matrix portion and containing MgO as a main component, wherein an area fraction of the first particle portion in a cross section is 0.6% or more and 19.6% or less.

2. The thixotropically molded product according to claim 1, wherein a total area of the second particle portion and the third particle portion in the cross section is 1.0 or more and 30.0 or less when an area of the first particle portion is 100.

3. The thixotropically molded product according to claim 1, wherein an average particle diameter of the first particle portion is 0.3 μm or more and 20.0 μm or less, an average particle diameter of the second particle portion is 10.0 μm or less, and an average particle diameter of the third particle portion is smaller than the average particle diameter of the second particle portion.

4. A thixotropic molding material comprising:

a metal body containing Mg as a main component;

silicon carbide particles adhering to a surface of the metal body and containing SiC as a main component; and interposed particles interposed between the metal body and the silicon carbide particles and made of an inorganic material, wherein a ratio of the silicon carbide particles to a total of the metal body and the silicon carbide particles is 1.0 mass % or more and 30.0 mass % or less.

5. The thixotropic molding material according to claim 4, wherein the inorganic material is a silicon oxide.

6. The thixotropic molding material according to claim 4, wherein an average particle diameter of the silicon carbide particles is 0.3 μm or more and 20 μm or less.

7. A method of producing a thixotropic molding material comprising:

a preparation step of preparing a mixture containing a metal body containing Mg as a main component, silicon carbide particles containing SiC as a main component, interposed particles made of an inorganic material, and a dispersion medium;

a stirring step of stirring the mixture; and a drying step of adhering the silicon carbide particles to a surface of the metal body via the interposed particles by removing at least a part of the dispersion medium from the stirred mixture, wherein in the mixture, a ratio of the silicon carbide particles to a total of the metal body and the silicon carbide particles is 1.0 mass % or more and 30.0 mass % or less.

* * * * *